US006243628B1

(12) United States Patent
Bliley et al.

(10) Patent No.: US 6,243,628 B1
(45) Date of Patent: Jun. 5, 2001

(54) SYSTEM AND METHOD FOR PREDICTING IMPENDING FAILURES IN A LOCOMOTIVE

(75) Inventors: Richard Gerald Bliley; William Roy Schneider, both of Erie, PA (US); Vinay Bhaskar Jammu, Niskayuna, NY (US)

(73) Assignee: General Electric Company, Schnectady, NY (US)

( * ) Notice: Subject to any disclaimer, the term of this patent is extended or adjusted under 35 U.S.C. 154(b) by 0 days.

(21) Appl. No.: 09/389,739

(22) Filed: Sep. 7, 1999

(51) Int. Cl.[7] ..... G06F 7/00; G06F 17/00
(52) U.S. Cl. ..... 701/29; 701/19
(58) Field of Search ..... 701/29, 33, 19; 702/183, 185; 706/913

(56) References Cited

U.S. PATENT DOCUMENTS 5,463,768 * 10/1995 Cuddihy et al. ..... 714/37
5,566,091 * 10/1996 Schricker et al. ..... 702/34
5,845,272 12/1998 Morjaria et al. .
5,950,147 * 9/1999 Sarangapani et al. ..... 702/179

* cited by examiner

*Primary Examiner*—Michael J. Zanelli
(74) *Attorney, Agent, or Firm*—Jill Breedlove; Carl Rowold

(57) ABSTRACT

A computer-based method and system for predicting impending failures in a system, such as a locomotive, aircraft, power plant, etc., having a plurality of subsystems is provided. The method allows for storing log data indicative of respective incidents or events that may occur as each of the subsystems is operative. A detecting step allows for detecting predetermined trend patterns in the log incident data. A mapping step allows for mapping each detected trend pattern into a respective prediction of an impending failure of a respective one of the subsystems of the locomotive, and an informing or outputting step allows for informing a respective user of the failure prediction so as to allow the user to take corrective action before the predicted failure occurs.

46 Claims, 3 Drawing Sheets

SYSTEM AND METHOD FOR PREDICTING IMPENDING FAILURES IN A LOCOMOTIVE

BACKGROUND OF THE INVENTION

The present invention relates generally to systems (e.g., locomotives) that are made up of a plurality of subsystems, and, more particularly, to a system and method using trend patterns detected in log data of a plurality of subsystems of the locomotive for predicting impending failures in the subsystems.

As will be appreciated by those skilled in the art, a locomotive is a complex electromechanical system comprised of several complex subsystems. Each of these subsystems is built from components which over time fail. The ability to automatically predict failures before they occur in the locomotive subsystems is desirable for several reasons. For example, that ability is important for reducing the occurrence of primary failures which result in stoppage of cargo and passenger transportation. These failures can be very expensive in terms of lost revenue due to delayed cargo delivery, lost productivity of passengers, other trains delayed due to the failed one, and expensive on-site repair of the failed locomotive. Further, some of those primary failures could result in secondary failures that in turn damage other subsystems and/or components. It will be further appreciated that the ability to predict failures before they occur would allow for conducting condition-based maintenance, that is, maintenance conveniently scheduled at the most appropriate time based on statistically and probabilistically meaningful information, as opposed to maintenance performed regardless of the actual condition of the subsystems, such as would be the case if the maintenance is routinely performed independently of whether the subsystem actually needs the maintenance or not. Needless to say, a condition-based maintenance is believed to result in a more economically efficient operation and maintenance of the locomotive due to substantially large savings in cost. Further, such type of proactive and high-quality maintenance will create an immeasurable, but very real, good will generated due to increased customer satisfaction. For example, each customer is likely to experience improved transportation and maintenance operations that are even more efficiently and reliably conducted while keeping costs affordable since a condition-based maintenance of the locomotive will simultaneously result in lowering maintenance cost and improving locomotive reliability.

Previous attempts to overcome the above-mentioned issues have been generally limited to diagnostics after a problem has occurred, as opposed to prognostics, that is, predicting a failure prior to its occurrence. For example, previous attempts to diagnose problems occurring in a locomotive have been performed by experienced personnel who have in-depth individual training and experience in working with locomotives. Typically, these experienced individuals use available information that has been recorded in a log. Looking through the log, the experienced individuals use their accumulated experience and training in mapping incidents occurring in locomotive subsystems to problems that may be causing the incidents. If the incident-problem scenario is simple, then this approach works fairly well for diagnosing problems. However, if the incident-problem scenario is complex, then it is very difficult to diagnose and correct any failures associated with the incident and much less to prognosticate the problems before they occur.

Presently, some computer-based systems are being used to automatically diagnose problems in a locomotive in order to overcome some of the disadvantages associated with completely relying on experienced personnel. Once again, the emphasis on such computer-based systems is to diagnose problems upon their occurrence, as opposed to prognosticating the problems before they occur. Typically, such computer-based systems have utilized a mapping between the observed symptoms of the failures and the equipment problems using techniques such as a table look up, a symptom-problem matrix, and production rules. These techniques may work well for simplified systems having simple mappings between symptoms and problems. However, complex equipment and process diagnostics seldom have simple correspondences between the symptoms and the problems. Unfortunately, as suggested above, the usefulness of these techniques have been generally limited to diagnostics and thus even such computer-based systems have not been able to provide any effective solution to being able to predict failures before they occur.

In view of the above-mentioned considerations, there is a need to be able to quickly and efficiently prognosticate any failures before such failures occur in the locomotive subsystems, while minimizing the need for human interaction and optimizing the repair and maintenance needs of the subsystem so as to able to take corrective action before any actual failure occurs.

BRIEF SUMMARY OF THE INVENTION

Generally speaking, the present invention fulfills the foregoing needs by providing a computer-based method for predicting impending failures in a system, such as a locomotive, aircraft, power plant, etc., having a plurality of subsystems. The method allows for storing log data indicative of respective incidents or events that may occur as each of the subsystems is operative. A detecting step allows for detecting predetermined trend patterns in the log incident data. A plurality of externally-derived tables containing diagnostic knowledge data may be optionally provided. In this case, a matching step would allow for matching a detected trend pattern with one or more of the tables containing diagnostic knowledge data so as to generate a matched trend pattern. A mapping step allows for mapping each respective matched or detected trend pattern into a respective prediction of an impending failure of a respective one of the subsystems of the locomotive, and an informing or outputting step allows for informing a respective user of the failure prediction so as to allow the user to take corrective action before the predicted failure occurs.

The present invention may further fulfill the foregoing needs by providing a system for predicting impending failures in a locomotive having a plurality of subsystems. The system may comprise a storage unit, such as an electronic database, having a first subsection for storing log data indicative of respective incidents that may occur as each of the subsystems is operative. A trend detector is coupled to receive the log data from the database to detect predetermined trend patterns in the received log data. A diagnostic knowledge database may be optionally configured to store a plurality of externally-derived tables of diagnostic knowledge data. A matching module is coupled to receive a detected trend pattern from the trend detector and, may be optionally coupled to the diagnostic knowledge database to match the detected trend pattern with one or more of the tables of diagnostic knowledge so as to generate a matched trend pattern. The matching module includes a mapping module configured to map each respective matched or detected trend pattern into a respective prediction of an impending failure of a respective one of the subsystems of the locomotive. Lastly, module output means may also be provided for informing a respective user of a respective failure prediction so as to allow the user to take corrective action before the impending failure actually occurs.

BRIEF DESCRIPTION OF THE DRAWINGS

For a better understanding of the present invention, reference may be had to the following detailed description taken in conjunction with the accompanying drawings in which.

DETAILED DESCRIPTION OF THE INVENTION

Figure 1:
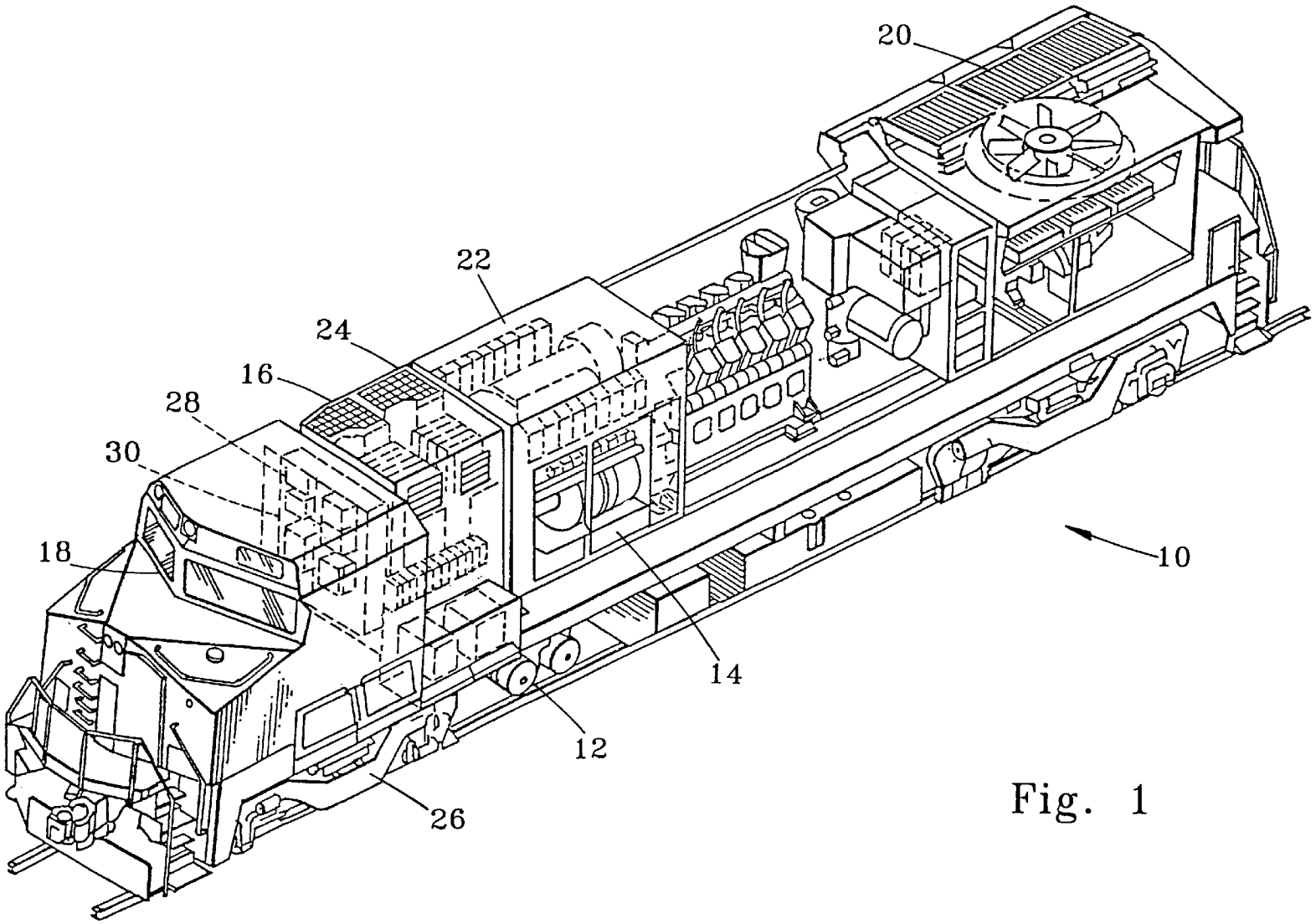
FIG. 1 shows an exemplary schematic of a locomotive.

It will be appreciated by those skilled in the art, that although the present invention is described in the context of a locomotive, the teachings of the present invention are readily applicable to other types of systems made up of multiple subsystems. By way of example and not of limitation some systems that may benefit may include automobiles, aircraft, marine vehicles, power plants, communication systems, heating ventilation and air conditioning systems, imaging systems, broadcasting systems, industrial control systems, etc. FIG. 1 shows a schematic of a locomotive 10. The locomotive may be either an AC or DC locomotive. The locomotive 10 is comprised of several relatively complex subsystems, each performing separate functions. By way of example some of the subsystems and their functions are listed below. It will be appreciated that the locomotive 10 is comprised of many other subsystems and that the present invention is not limited to the subsystems disclosed herein.

An air and air brake sub-system 12 provides compressed air to the locomotive, which uses the compressed air to actuate the air brakes on the locomotive and cars behind it.

An auxiliary alternator sub-system 14 powers all auxiliary equipment. In particular, subsystem 14 supplies power directly to an auxiliary blower motor and an exhauster motor. Other equipment in the locomotive is powered through a cycle skipper.

A battery and cranker sub-system 16 provides voltage to maintain the battery at an optimum charge and supplies power for operation of a DC bus and a HVAC system.

A communications sub-system collects, distributes, and displays communication data across each locomotive operating in hauling operations that use multiple locomotives.

A cab signal sub-system 18 links the wayside to the train control system. In particular, the system 18 receives coded signals from the rails through track receivers located on the front and rear of the locomotive. The information received is used to inform the locomotive operator of the speed limit and operating mode.

A distributed power control sub-system provides remote control capability of multiple locomotive-consists anywhere in the train. It also provides for control of tractive power in motoring and braking, as well as air brake control.

An engine cooling sub-system 20 provides the means by which the engine and other components reject heat to the cooling water. In addition, it minimizes engine thermal cycling by maintaining an optimal engine temperature throughout the load range and prevents overheating in tunnels.

An end of train sub-system provides communication between the locomotive cab and the last car via a radio link for the purpose of emergency braking.

An equipment ventilation sub-system 22 provides the means to cool the locomotive equipment.

An event recorder sub-system records FRA required data and limited defined data for operator evaluation and accident investigation. For example, such recorder may store about 72 hours or more of data.

For example, in the case of a locomotive that uses one or more diesel engines, a fuel monitoring sub-system provides means for monitoring the fuel level and relaying the information to the crew.

A global positioning sub-system uses NAVSTAR satellite signals to provide accurate position, velocity and altitude measurements to the control system. In addition, it also provides a precise UTC reference to the control system.

A mobile communications package sub-system provides the main data link between the locomotive and the wayside via a 900 MHz radio.

A propulsion sub-system 24 provides the means to move the locomotive. It also includes the traction motors and dynamic braking capability. In particular, the propulsion sub-system 24 receives electric power from the traction alternator and through the traction motors, converts that power to locomotive movement. The propulsion subsystem may include speed sensors that measure wheel speed that may be used in combination with other signals for controlling wheel slip or creep either during motoring or braking modes of operation using control technique well understood by those skilled in the art.

A shared resources sub-system includes the I/O communication devices, which are shared by multiple subsystems.

A traction alternator sub-system 26 converts mechanical power to electrical power which is then provided to the propulsion system.

A vehicle control sub-system reads operator inputs and determines the locomotive operating modes.

The above-mentioned subsystems are monitored by one or more locomotive controllers, such as a locomotive control system 28 located in the locomotive. The locomotive control system 28 keeps track of any incidents occurring in the subsystems with an incident log. An on-board diagnostics sub-system 30 receives the incident information supplied from the control system and maps some of the recorded incidents to indicators. The indicators are representative of observable symptoms detected in the subsystems. Further background information regarding an exemplary diagnostic subsystem may be found in U.S. Pat. No. 5,845,272, assigned to the same assignee of the present invention and herein incorporated by reference.

Figure 2:
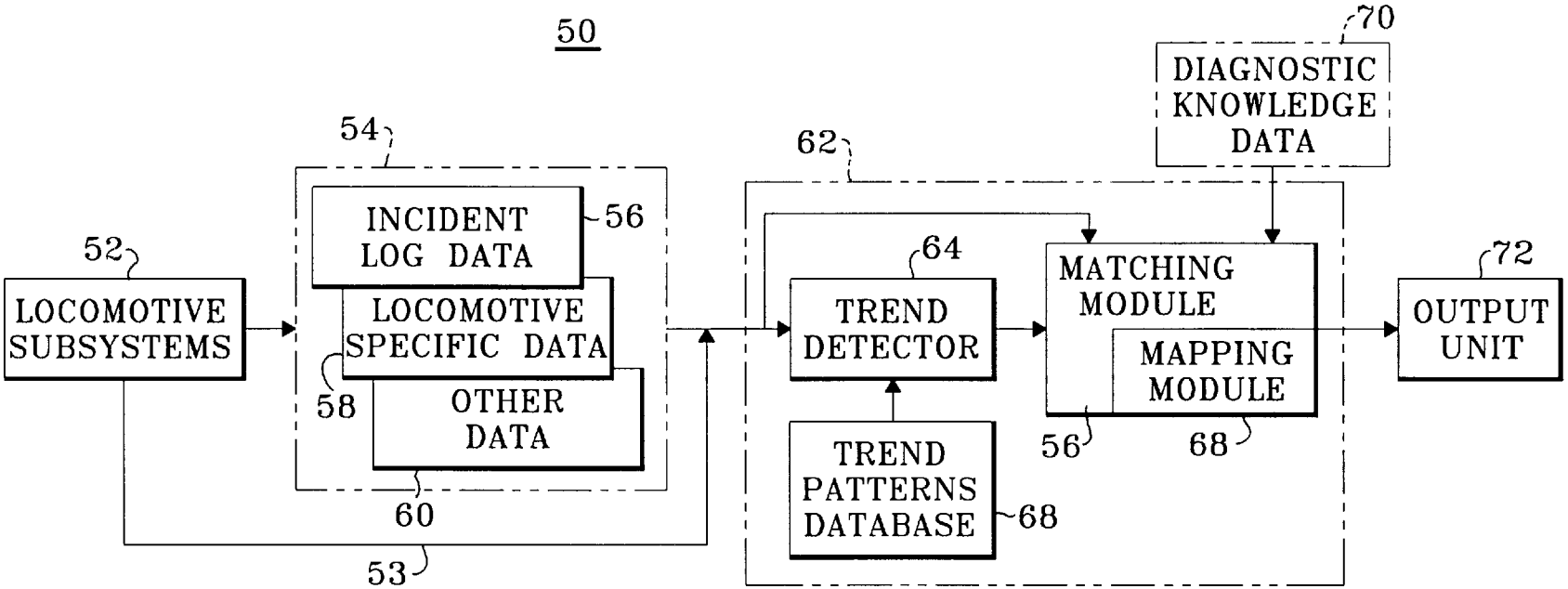
FIG. 2 shows a block diagram of an on-board system for predicting failures in the locomotive in accordance with the present invention.

FIG. 2 shows a block diagram of an exemplary embodiment of a system 50 for predicting impending failures in the locomotive before the occurrence of such failures. As suggested in the context of FIG. 1, each respective locomotive subsystem, collectively represented by block 52, may be coupled to a storage unit, such as an electronic database 54 having a first subsection 56 for storing log data indicative of respective incidents or faults that may occur as each locomotive subsystem 52 is operated in the locomotive. Database 54 may further include a second subsection 58 for storing locomotive-specific data, such as data indicative of whether the locomotive is an AC or a DC locomotive, or if it has two, two and half, or three grid legs for dynamic braking, or if it has split cooling system or not, or if it has fuses or cutout switches, etc. A third subsection 60 in the database 54 may be used for storing subsystem signals indicative of various locomotive operational parameters, such as signals indicative of the ground speed of the locomotive, or locomotive engine speed, or respective temperatures of water and oil in the engine subsystem, or main alternator current and voltage, or direction (forward or reverse) of the locomotive travel, etc. A failure predictor subsystem 62 having a trend detector 64 and a matching module 66 allows for processing the data stored in database 54 so as to predict the occurrence of impending faults in locomotive subsystems 52. Trend detector 64 is coupled to receive the log data stored in database subsection 56 to detect predetermined trend patterns in the received log data. It will be appreciated that the log data may be readily made up of a plurality of fault codes indicative of one or more incidents or faults. The log data need not be limited to incidents or faults since other type of data could be readily used, e.g., data indicative of events that may occur in connection with any of the locomotive subsystems, such as temporary exposure to harsh environmental or operational conditions. It will be further appreciated that the incident data need not be supplied to the trend detector through a storage unit since in some applications such incident data could be directly supplied from the respective subsystems to the trend detector via any suitable data communications link, e.g., wired or wireless data link 53. A trend pattern database 68 may be readily used to store a plurality of predetermined trend patterns or trending algorithms used by trend detector 64. By way of example and not of limitation, below are some possible trend patterns that could be conveniently used by trend detector 64. It will be appreciated that depending on the specific implementation, other types of trend patterns may be readily adapted to handle any such specific implementation.

1. A fault code X has occurred Y times in a time interval of, for example, M minutes or D days.

2. A fault code X has occurred Y times in a first time interval of M1 minutes, each successive occurrence separated from the previous occurrence by a second time interval of M2 minutes.

3. A first fault code X has jointly occurred with a second fault code Y, but not with a third fault code Z over a time interval of M minutes.

4. Fault codes X and Y occurred substantially alternately over a time interval of M minutes.

5. A first fault code X occurred substantially intermittently over M minutes, followed by the occurrence of a second fault code Y.

6. The rate of occurrence of fault code X over a time interval of M minutes.

7. The ratio of the number of occurrences of a first fault code X relative to the occurrences of a second fault code over a time interval of M minutes.

8. The rate of change of the ratio of the number of occurrences of a first fault code X relative to the occurrences of a second fault code over a time interval of M minutes.

It will be readily appreciated by those skilled in the art, that in the above-listed exemplary trending algorithms, the alphanumeric characters X, Y, Z, M, M1, M2, are meant to represent generic parameters that are substituted with specific fault codes, time intervals, and subsystem status signals to identify different trend patterns.

As suggested above, matching module 66 may use one or more of a plurality of externally-derived tables containing diagnostic knowledge data such as may be stored in a diagnostic knowledge database 70. By way of background information, and as more fully described in the above-referred patent in the context of an exemplary system for isolating failures in the locomotive, the diagnostic knowledge database 70 generally has diagnostic information about failures that have occurred in each of the subsystems and observable symptoms that can happen in each of the subsystems due to such failures. A fault isolator may comprise a diagnostic engine that processes mapped indicators with the diagnostic information in the diagnostic knowledge base. By way of example, the diagnostic information in the diagnostic knowledge base may comprise a plurality of causal networks, each having a plurality of nodes for each of the locomotive subsystems. Each causal network has a cause and effect relationship between some of the plurality of nodes, wherein some of the nodes represent root causes associated with failures in each of the subsystems and some of the nodes represent observable manifestations of the failures or fault codes. Each of the root causes in the causal networks has a prior probability indicating the likelihood of a failure in the absence of any additional knowledge provided from either a manual indicator or the log data. Also, each of the nodes in the causal networks has conditional probability information representing the strength of the relationships of the node to its causes. For the purposes of the present invention, matching module 66 allows for matching any detected trend pattern with one or more of the tables containing the externally-derived diagnostic knowledge information so as to generate a matched trend pattern. The matching module may use any suitable pattern recognition technique as will now become readily apparent to one of ordinary skill in the art. By way of example and not of limitation, such techniques may include pure binary comparison, closest match using minimal Euclidean distance between patterns, Rule-based expert systems, Look up tables, Bayesian Belief Networks, Case-Based Reasoning, etc. For additional background information in connection with these well-understood techniques to one of ordinary skill in the art, the reader is referred to a textbook entitled *Probabilistic Reasoning in Expert Systems: Theory and Algorithms* by R. E. Neapolitan, available from John Wiley & Sons, Inc., 1990. Another reference that may be helpful to one desiring to learn more details about the subject of pattern recognition techniques may be textbook entitled *Pattern Classification and Scene Analysis*, by R. O. Duda and P. E. Hart published by Wiley, New York N.Y. 1973. Another reference for Case-Based Reasoning techniques is the textbook entitled *Case-based Reasoning*, by Kolodner, Janet L., published by Morgan Kaufmann, San Mateo, Calif. 1993. The above-listed background references are incorporated herein by reference.

The matched or detected trend pattern from matching module 66 is then mapped by a mapping module 68 into a respective prediction of an impending failure of a respective one of the subsystems of the locomotive. An output unit 72 allows to issue a message containing the respective failure prediction to a respective user so as to allow that user to take corrective action before the predicted failure occurs. By way of example, the message could be stored to be retrieved shortly by the user or could be transmitted using suitable communications equipment, essentially in real time, to a center of maintenance operations so as to best schedule any appropriate corrective action based on the likely of the severity of the predicted failure.

Figure 3:
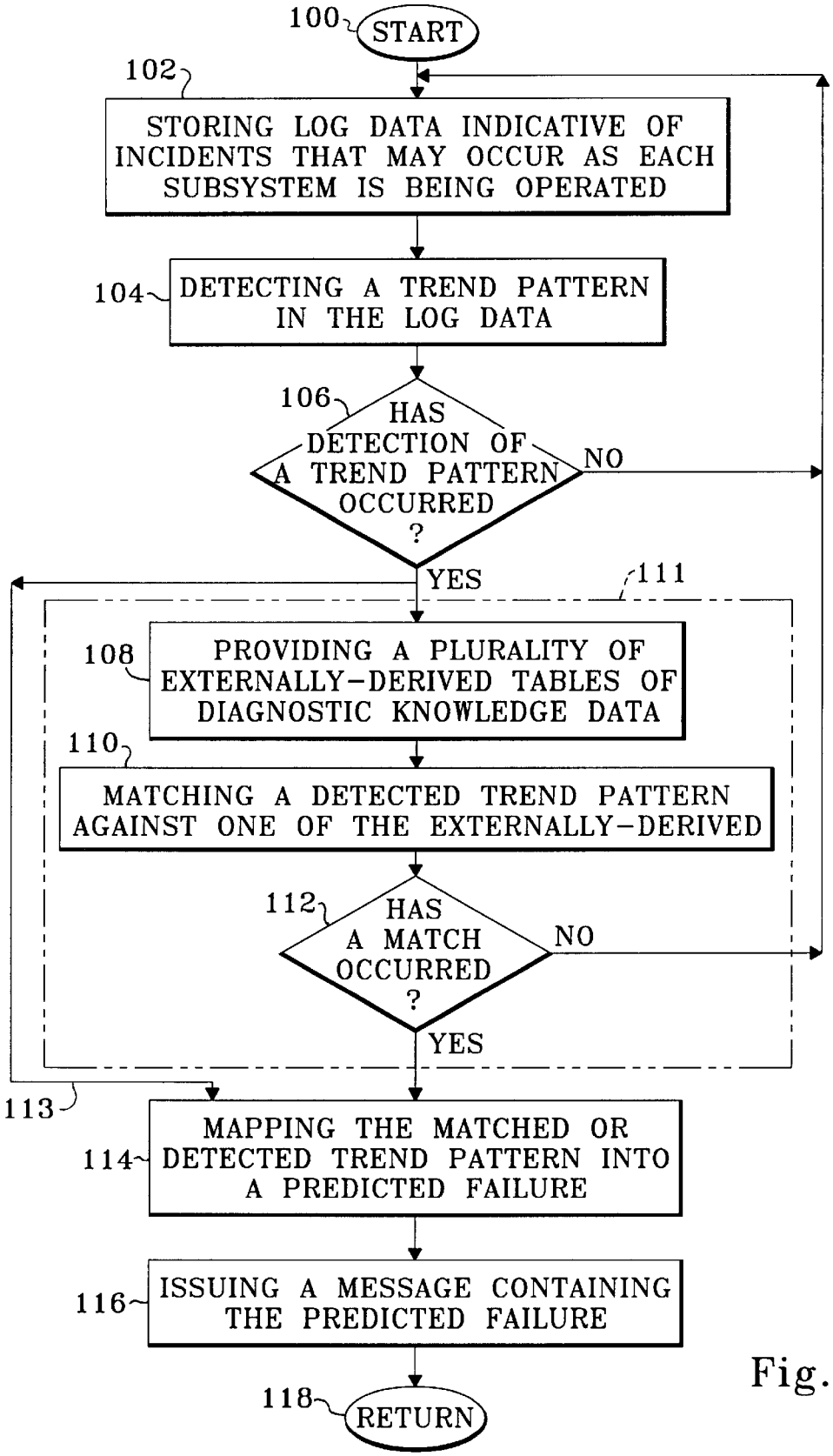
FIG. 3 is a flowchart illustrating a method for predicting failures such as may be implemented by the system of FIG. 2.

FIG. 3 shows a flow chart of a method for predicting impending failures in a locomotive having a plurality of subsystems. Subsequent to start of operations in step 100, step 102 allows for storing log data indicative of respective incidents or events that may occur as each of the subsystems is operative. Step 104 allows for detecting a trend pattern in the log data. Examples of some trend patterns were provided in the context of FIG. 1 and will not be repeated. Step 106 allows for determining whether detection of a trend pattern has occurred. If no detection has occurred, a new iteration commences at step 100. If detection of a trend pattern has occurred, then optional step 108 allows for matching a detected trend pattern with one or more tables containing diagnostic knowledge data so as to generate a matched pattern. As suggested above, a matched trend pattern results when there is a sufficiently acceptable probability that in fact the detected trend pattern is indicative of a likely future failure of a given subsystem, as opposed to a trending pattern that could be due to purely coincidental or extraneous factors, not fully attributable, at least not with a sufficiently acceptable probability, to root causes that would likely result in the subsystem failure normally associated with the detected trend pattern. Step 112, allows for determining whether a match has occurred using a matching algorithm that, as suggested above, may be readily executed using pattern recognition techniques well understood by one of ordinary skill in the art. If no match has occurred, then a new iteration commences at step 100. As suggested above, optional steps 108 and 100 within block 111, drawn with dashed lines, represent steps that depending on the specific application may be conveniently bypassed since once detection of a trend pattern has occurred, the method may be configured to go directly to a mapping step 114, as illustrated by connecting line 113. In either case, mapping step 114 allows to map the matched or detected pattern into a predicted failure. Prior to return step 118, step 116 allows for issuing a message containing the predicted failure to the user so that the user can take appropriate corrective action prior to the failure of the subsystem.

For the sake of simplicity of description, one relatively straight forward example in connection with predicting a respective speed sensor failure in the traction motor subsystem of the locomotive is provided below. As used in Table 1 below, the letter X may represent a selected time interval of 24 hours. The alphanumeric characters, such as 7210-02 represent a unique fault code identification. As will be understood by one skilled in the art, the trending algorithm illustrated in Table 1 is of the type corresponding to detecting occurrence of a first fault code (e.g., fault code 7210-02) jointly with the occurrence of a second fault code (e.g., fault code 7219-02) over the selected time interval, e.g., 24 hours. Further, since the traction motor usually requires three phases, there are three combinations of trending patterns used for determining an impending failure in a speed sensor. The three combinations are respectively illustrated in Table 1, by the three logical "OR" connectors. Table 2 defines the specific fault events or incidents associated with a respective fault code. For example, fault code 7210-02 may be indicative of a positive overcurrent condition detected in a phase module 1A or a negative overcurrent condition detected in phase module 1A or an overcurrent condition detected in a respective inverter motor controller. It should be noted that even in the above-described straightforward example, a prediction of a speed sensor fault is not simply announced upon detection of the trending pattern since, for example, as suggested above, the matching module would generally use additional signals, such as signals indicative of predetermined locomotive parameters so as to enhance the accuracy of the predicted fault. For example, the locomotive parameter could be indicative of spurious faults that may occur during an aborted or prematurely interrupted test, such as may occur during interruption of a battery voltage-current (VI) switch test that may generate a signal in the data pack which when on indicates that the speed sensor faults that occurred are not valid since spurious faults could be produced when the battery VI test is interrupted prior to completion. Thus, the matching module is conveniently configured to use such additional information so as to reduce the issuance of erroneous predictions. Similarly, if an overcurrent condition is generated by a respective phase module while other faults indicative of a faulty phase module are logged, then even though the first and second fault codes may occur within the 24 hour time interval, the use of such additional fault codes by the matching module would substantially preclude the issuance of a speed sensor failure prediction being that the incident may not be clearly attributable to the speed sensor itself. Thus, it will be appreciated that use of such signals indicative of subsystem status conveniently allows the matching module to have a robust or enhanced capability for avoiding issuance of erroneous predictions. Table 3 illustrates experimental data obtained from three different locomotives that corroborates that the predictor system of the present invention using the trending algorithm described in the context of Tables 1 and 2 would have successfully predicted the failure of a given speed sensor without having to wait until the sensor had to be replaced due to such failure.

TABLE 1

| FAULTS | | FAULTS | TIME (X = 1) |
|---|---|---|---|
| PHASE A | and | PHASE B | |
| 7210-02 | and | 7219-02 | LOGGED WITHIN XDAYS INDICATES SS#1 IS FAILING |
| 7290-02 | and | 7299-02 | LOGGED WITHIN XDAYS INDICATES SS#2 IS FAILING |
| 7310-02 | and | 7319-02 | LOGGED WITHIN XDAYS INDICATES SS#3 IS FAILING |
| 7390-02 | and | 7399-02 | LOGGED WITHIN XDAYS INDICATES SS#4 IS FAILING |
| 7410-02 | and | 7419-02 | LOGGED WITHIN XDAYS INDICATES SS#5 IS FAILING |
| 7490-02 | and | 7499-02 | LOGGED WITHIN XDAYS INDICATES SS#6 IS FAILING |
| PHASE B | or and | PHASE C | |
| 7219-02 | and | 7222-02 | LOGGED WITHIN XDAYS INDICATES SS#1 IS FAILING |
| 7299-02 | and | 72A2-02 | LOGGED WITHIN XDAYS INDICATES SS#2 IS FAILING |
| 7319-02 | and | 7322-02 | LOGGED WITHIN XDAYS INDICATES SS#3 IS FAILING |
| 7399-02 | and | 73A2-02 | LOGGED WITHIN XDAYS INDICATES SS#4 IS FAILING |
| 7419-02 | and | 7422-02 | LOGGED WITHIN XDAYS INDICATES SS#5 IS FAILING |
| 7499-02 | and | 74A2-02 | LOGGED WITHIN XDAYS INDICATES SS#6 IS FAILING |
| PHASE A | or and | PHASE C | |
| 7210-02 | and | 7222-02 | LOGGED WITHIN XDAYS INDICATES SS#1 IS FAILING |
| 7290-02 | and | 72A2-02 | LOGGED WITHIN XDAYS INDICATES SS#2 IS FAILING |
| 7310-02 | and | 7322-02 | LOGGED WITHIN XDAYS INDICATES SS#3 IS FAILING |

TABLE 1-continued

| FAULTS | | FAULTS | TIME (X = 1) |
|---|---|---|---|
| 7390-02 | and | 73A2-02 | LOGGED WITHIN XDAYS INDICATES SS#4 IS FAILING |
| 7410-02 | and | 7422-02 | LOGGED WITHIN XDAYS INDICATES SS#5 IS FAILING |
| 7490-02 | and | 74A2-02 | LOGGED WITHIN XDAYS INDICATES SS#6 IS FAILING |

TABLE 2

| | |
|---|---|
| 7210-02 | PM1A+ OR PM1A− OR IMC1-3,4,7 BAD MEANS* |
| 7290-02 | PM2A+ OR PM2A− OR IMC1-3,4,7 BAD MEANS* |
| 7310-02 | PM3A+ OR PM3A− OR IMC2-3,4,7 BAD MEANS* |
| 7390-02 | PM4A+ OR PM4A− OR IMC2-5,6,7 BAD MEANS* |
| 7410-02 | PM5A+ OR PM5A− OR IMC3-3,4,7 BAD MEANS* |
| 7490-02 | PM6A+ OR PM6A− OR IMC3-5,6,7 BAD MEANS* |
| 7219-02 | PM1B+ OR PM1B− OR IMC1-3,4,7/TMC-1,0 BAD MEANS** |
| 7299-02 | PM2B+ OR PM2B− OR IMC1-5,6,7/TMC-2,0 BAD MEANS** |
| 7319-02 | PM3B+ OR PM3B− OR IMC2-3,4,7/TMC-3,0 BAD MEANS** |
| 7399-02 | PM4B+ OR PM4B− OR IMC2-5,6,7/TMC-4,7 BAD MEANS** |
| 7419-02 | PM5B+ OR PM5B− OR IMC3-3,4,7/TMC-5,7 BAD MEANS** |
| 7499-02 | PM6B+ OR PM6B− OR IMC3-5,6,7/TMC-6,7 BAD MEANS** |
| 7222-02 | PM1C+ OR PM1C− OR IMC1-3,4,7/TMC-1,0 BAD MEANS*** |
| 72A2-02 | PM2C+ OR PM2C− OR IMC1-3,4,7/TMC-2,0 BAD MEANS*** |
| 7322-02 | PM3C+ OR PM3C− OR IMC2-3,4,7/TMC-3,0 BAD MEANS*** |
| 73A2-02 | PM4C+ OR PM4C− OR IMC2-5,6,7/TMC-4,7 BAD MEANS*** |
| 7422-02 | PM5C+ OR PM5C− OR IMC3-3,4,7/TMC-5,7 BAD MEANS*** |
| 74A2 02 | PM6C+ OR PM6C− OR IMC3-5,6,7/TMC-6,7 BAD MEANS*** |

*Phase A Inverter Overcurrent was detected
**Phase B Inverter Overcurrent was detected
***Phase C Inverter Overcurrent was detected

TABLE 3

| | |
|---|---|
| CSX 133 | LOGGED 7299 AND 72A2 0.00 HOURS APART<br>LOGGED 72AC (SS#2 TACH 1) 0.00 HOURS LATER<br>SS#2 CHANGED 11 DAYS LATER |
| CSX 150 | LOGGED 7219 AND 7222 AND 7210 0.00 HOURS APART<br>LOGGED 722C (SS#1 TACH 1) 174.92 HOURS LATER<br>SS#1 CHANGED 12 DAYS LATER |
| CSX 63 | LOGGED 7210 AND 7219 0.58 HOURS APART<br>LOGGED 722C (SS#1 TACH 1) 25.32 HOURS EARLIER<br>SS#1 CHANGED 62 DAYS LATER |

It will be understood that the specific embodiment of the invention shown and described herein is exemplary only. Numerous variations, changes, substitutions and equivalents will now occur to those skilled in the art without departing from the spirit and scope of the present invention. Accordingly, it is intended that all subject matter described herein and shown in the accompanying drawings be regarded as illustrative only and not in a limiting sense and that the scope of the invention be solely determined by the appended claims.

What is claimed is:

1. A computer-based method for predicting impending failures in a locomotive having a plurality of subsystems comprising:

storing log data indicative of respective incidents that may occur as each of the subsystems is operative;

detecting predetermined trend patterns in the incident log data;

mapping each respective detected trend pattern into a respective prediction of an impending failure of a respective one of the subsystems of the locomotive; and informing a respective user about the respective predicted failure so as to allow the user to take corrective action before the predicted failure occurs.

2. The predicting method of claim 1 further comprising a plurality of externally-derived tables containing diagnostic knowledge data.

3. The predicting method of claim 2 further comprising matching a detected trend pattern with one or more of the tables containing diagnostic knowledge data so as to generate a matched trend pattern.

4. The predicting method of claim 3 wherein the matching step comprises using predetermined pattern recognition techniques to generate the matched trend pattern.

5. The predicting method of claim 1 wherein the mapping step comprises using locomotive-specific data so as to enhance generation of a substantially accurate match for the trend pattern.

6. The predicting method of claim 5 wherein the mapping step comprises using data indicative of predetermined locomotive parameters so as to further enhance generation of a substantially accurate match for the trend pattern.

7. The predicting method of claim 1 wherein the log data comprises a plurality of respective fault codes.

8. The predicting method of claim 7 wherein the detecting step comprises detecting whether a respective fault code has occurred a predetermined number of times over a selected interval of time.

9. The predicting method of claim 7 wherein the detecting step comprises detecting whether a respective fault code has occurred a predetermined number of times over a first selected interval time, each successive occurrence being separated from the previous occurrence by a second selected interval of time.

10. The predicting method of claim 7 wherein the detecting step comprises detecting whether a first fault code occurred along with a second fault code but not with a third fault code over a selected interval of time.

11. The predicting method of claim 7 wherein the detecting step comprises detecting whether respective first and second fault codes have alternately occurred over a selected interval of time.

12. The predicting method of claim 7 wherein the detecting step comprises detecting whether a respective first fault code occurred intermittently over a selected interval followed by the occurrence of a respective second fault code.

13. The predicting method of claim 7 wherein the detecting step comprises detecting a rate of occurrence of a respective fault code over a selected interval of time.

14. The predicting method of claim 7 wherein the detecting step comprises detecting a ratio of the number of occurrences of a respective first fault code relative to a respective second fault code over a selected interval of time.

15. The predicting method of claim 14 wherein the detecting step comprises detecting a rate of change in the ratio of the number of occurrences of the respective first fault code relative to the respective second fault code over the selected interval of time.

16. A system for predicting impending failures in a locomotive having a plurality of subsystems comprising:

an storage unit having a first subsection for storing log data indicative of respective incidents that may occur as each of the subsystems is operative;

a trend detector coupled to receive the log data from the storage unit to detect predetermined trend patterns in the received log data;

a matching module coupled to receive a detected trend pattern and including a mapping module configured to map each detected trend pattern into a respective prediction of an impending failure of a respective one of the subsystems of the locomotive; and means for informing a user indicating the predicted failure so as to allow the user to take corrective action before the impending failure actually occurs.

17. The predicting system of claim 16 further comprising a diagnostic knowledge database configured to store a plurality of externally-derived tables of diagnostic knowledge data.

18. The predicting system of claim 16 wherein the matching module is coupled to the diagnostic knowledge database to match the detected trend pattern with one or more of the tables of diagnostic knowledge.

19. The predicting system of claim 18 wherein the matching module uses predetermined pattern recognition techniques to generate a matched trend pattern.

20. The predicting system of claim 16 wherein the matching module receives locomotive-specific data stored in a second subsection of the storage unit so as to enhance generation of a substantially accurate match for the trend pattern.

21. The predictive system of claim 20 wherein the matching module receives data indicative of predetermined locomotive parameters stored in a third subsection of the storage unit so as to further enhance generation of a substantially accurate match for the trend pattern.

22. The predicting system of claim 16 wherein the log data comprises a plurality of respective fault codes.

23. The predicting system of claim 22 wherein the trend detector is configured to detect whether a respective fault code has occurred a predetermined number of times over a selected interval of time.

24. The predicting system of claim 22 wherein the trend detector is configured to detect whether a respective fault code has occurred a predetermined number of times over a first selected interval time, each successive occurrence being separated from the previous occurrence by a second selected interval of time.

25. The predicting system of claim 22 wherein the trend detector is configured to detect whether a first fault code occurred along with a second fault code but not with a third fault code over a selected interval of time.

26. The predicting system of claim 22 wherein the trend detector is configured to detect whether respective first and second fault codes have alternately occurred over a selected interval of time.

27. The predicting system of claim 22 wherein the trend detector is configured to detect whether a respective first fault code occurred intermittently over a selected interval followed by the occurrence of a respective second fault code.

28. The predicting system of claim 22 wherein the trend detector is configured to detect a rate of occurrence of a respective fault code over a selected interval of time.

29. The predicting system of claim 22 wherein the trend detector is configured to detect a ratio of the number of occurrences of a respective first fault code relative to a respective second fault code over a selected interval of time.

30. The predicting system of claim 22 wherein the trend detector is configured to detect a rate of change in the ratio of the number of occurrences of the respective first fault code relative to the respective second fault code over the selected interval of time.

31. The predicting system of claim 30 wherein the trend detector is configured to detect the occurrence of one or more predetermined combinations of respective fault codes while predetermined combinations of respective subsystem signals indicative of respective operational conditions of the subsystems reach a predetermined signal level.

32. Apparatus for predicting impending failures in a system including a plurality of subsystems, the apparatus comprising:

communication means for supplying log data indicative of respective incidents or events that may occur as each of the subsystems is operative;

a trend detector coupled to receive the supplied log data to detect predetermined trend patterns in the received log data;

a matching module coupled to receive a detected trend pattern and including a mapping module configured to map each detected trend pattern into a respective prediction of an impending failure of a respective one of the subsystems; and an output unit configured to inform a respective user about the predicted failure so as to allow the user to take corrective action before the impending failure actually occurs.

33. The predicting apparatus of claim 32 further comprising a diagnostic knowledge database configured to store a plurality of externally-derived tables of diagnostic knowledge data.

34. The predicting apparatus of claim 33 wherein the matching module is coupled to the diagnostic knowledge database to match the detected trend pattern with one or more of the tables of diagnostic knowledge.

35. The predicting apparatus of claim 34 wherein the matching module uses predetermined pattern recognition techniques to generate a matched trend pattern.

36. The predicting apparatus of claim 32 wherein the matching module receives system-specific data stored in a second subsection of the storage unit so as to enhance generation of a substantially accurate match for the trend pattern.

37. The predicting apparatus of claim 36 wherein the matching module receives data indicative of predetermined system parameters stored in a third subsection of the storage unit so as to further enhance generation of a substantially accurate match for the trend pattern.

38. The predicting apparatus of claim 32 wherein the log data comprises a plurality of respective fault codes.

39. The predicting apparatus of claim 38 wherein the trend detector is configured to detect whether a respective fault code has occurred a predetermined number of times over a selected interval of time.

40. The predicting apparatus of claim 38 wherein the trend detector is configured to detect whether a respective fault code has occurred a predetermined number of times over a first selected interval time, each successive occurrence being separated from the previous occurrence by a second selected interval of time.

41. The predicting apparatus of claim 38 wherein the trend detector is configured to detect whether a first fault code occurred along with a second fault code but not with a third fault code over a selected interval of time.

42. The predicting apparatus of claim 38 wherein the trend detector is configured to detect whether respective first and second fault codes have alternately occurred over a selected interval of time.

43. The predicting apparatus of claim 38 wherein the trend detector is configured to detect whether a respective first fault code occurred intermittently over a selected interval followed by the occurrence of a respective second fault code.

44. The predicting apparatus of claim 38 wherein the trend detector is configured to detect a rate of occurrence of a respective fault code over a selected interval of time.

45. The predicting apparatus of claim 38 wherein the trend detector is configured to detect a ratio of the number of occurrences of a respective first fault code relative to a respective second fault code over a selected interval of time.

46. The predicting apparatus of claim 45 wherein the trend detector is configured to detect a rate of change in the ratio of the number of occurrences of the respective first fault code relative to the respective second fault code over the selected interval of time.

* * * * *